US008313418B2

(12) United States Patent
Ochi

(10) Patent No.: US 8,313,418 B2
(45) Date of Patent: Nov. 20, 2012

(54) PLAYING DEVICE

(75) Inventor: Yasushi Ochi, Izumisano (JP)

(73) Assignee: BLD Oriental, Ltd., Osaka (JP)

( * ) Notice: Subject to any disclaimer, the term of this patent is extended or adjusted under 35 U.S.C. 154(b) by 581 days.

(21) Appl. No.: 12/438,299

(22) PCT Filed: Aug. 21, 2007

(86) PCT No.: PCT/JP2007/066143

§ 371 (c)(1),
(2), (4) Date: Feb. 20, 2009

(87) PCT Pub. No.: WO2008/023674

PCT Pub. Date: Feb. 28, 2008

(65) Prior Publication Data

US 2010/0216369 A1 Aug. 26, 2010

(30) Foreign Application Priority Data

Aug. 24, 2006 (JP) ..... 2006-227513
Nov. 29, 2006 (JP) ..... 2006-321225

(51) Int. Cl.
*A63B 4/00* (2006.01)
*A63G 27/04* (2006.01)

(52) U.S. Cl. ..... 482/34; 472/44; 472/46

(58) Field of Classification Search ..... 482/34, 482/148; 273/440, 449; 472/44–46
See application file for complete search history.

(56) References Cited

U.S. PATENT DOCUMENTS 1,927,223 A * 9/1933 Sollanek et al. ..... 472/120
2,547,891 A * 4/1951 Smith ..... 297/281
3,545,747 A * 12/1970 Thomas ..... 273/449
3,806,118 A * 4/1974 Way ..... 273/449
3,887,179 A * 6/1975 Klepper et al. ..... 472/127
4,643,416 A * 2/1987 van der Veen ..... 472/45
4,787,631 A * 11/1988 Erumsele ..... 273/445
4,944,309 A * 7/1990 Mechling ..... 600/595
5,037,086 A * 8/1991 Strand ..... 482/34
5,188,566 A 2/1993 Bohme
5,803,816 A * 9/1998 Moser et al. ..... 472/46
5,941,777 A * 8/1999 Moser et al. ..... 472/44
6,164,654 A * 12/2000 Tricomi ..... 273/450
6,517,466 B2 * 2/2003 Eyman et al. ..... 482/34
6,739,974 B2 * 5/2004 Kanno et al. ..... 463/36
7,172,511 B2 * 2/2007 Casey ..... 472/47
(Continued)

FOREIGN PATENT DOCUMENTS

JP 10-314336 A 12/1998
(Continued)

*Primary Examiner* — Stephen Crow
(74) *Attorney, Agent, or Firm* — Smith Patent Office

(57) ABSTRACT

The present invention relates to a playing device with which a player can perform more diversified plays. A playing device 1 comprises a beam 11 disposed such that its longitudinal direction is directed laterally and which is configured such that a player Y can move on the outer circumferential surface thereof under a standing state along the longitudinal direction; a first support mechanism and a second support mechanism which are disposed at a distance in the longitudinal direction of the beam 11 for supporting the both end portions of the beam 11, respectively, the first support mechanism and the second support mechanism for supporting the beam 11 such that one or both end portions of the beam 11 can displaces freely in the direction intersecting the longitudinal direction; and a drive mechanism for driving the beam 11 to displace one or both end portions thereof in the intersecting direction.

15 Claims, 12 Drawing Sheets

U.S. PATENT DOCUMENTS

| | | | | |
|---|---|---|---|---|
| 7,402,110 | B2 * | 7/2008 | Casey | 472/47 |
| 7,645,221 | B1 * | 1/2010 | Curry | 482/148 |
| 7,959,513 | B2 * | 6/2011 | Ochi | 472/29 |
| 2007/0287547 | A1 * | 12/2007 | Gallagher | 472/89 |
| 2009/0093343 | A1 * | 4/2009 | Gallus et al. | 482/34 |
| 2009/0227426 | A1 * | 9/2009 | Dubar | 482/34 |
| 2010/0179029 | A1 * | 7/2010 | Ochi | 482/35 |
| 2010/0248922 | A1 * | 9/2010 | Ochi et al. | 482/142 |
| 2010/0273618 | A1 * | 10/2010 | Ozawa et al. | 482/142 |
| 2010/0273619 | A1 * | 10/2010 | Ozawa et al. | 482/146 |
| 2010/0279835 | A1 * | 11/2010 | Ozawa et al. | 482/142 |

FOREIGN PATENT DOCUMENTS

| | | | |
|---|---|---|---|
| JP | 2960157 | B | 7/1999 |
| JP | 2002-336374 | A | 11/2002 |

* cited by examiner

PLAYING DEVICE

TECHNICAL FIELD

The present invention relates to a playing device which comprises a beam arranged such that its longitudinal direction is directed laterally, and which is configured such that a player plays by walking or running on the outer circumferential surface of the beam along the longitudinal direction.

BACKGROUND ART

As a playing device, conventionally, the playing device disclosed in Japanese Unexamined Patent Application Publication No. 10-314336 is known, for example. This playing device includes: a beam which is arranged such that its longitudinal direction is directed laterally and which is configured such that a player can move on the outer circumferential surface thereof under a standing state along the longitudinal direction; and a first support member and a second support member which are arranged at a distance in the longitudinal direction of the beam, and which support both end portions of the beam, respectively.

The beam is formed to have a rectangular cross-sectional shape and to be curved along its longitudinal direction. Further, the beam and each support member are adapted to be detachably assembled by the engagement relationship between an engagement portion formed at either end portion in the longitudinal direction of the beam and an engagement groove formed on each support member. The convex portion of the beam curved in an arc shape is directed upwardly, downwardly, to the right side or to the left side.

In this playing device, the player such as a child can play by, for example, walking or running on the outer circumferential surface of the beam along the longitudinal direction while keeping his/her balance. The convex portion of the beam curved in arc shape is directed upwardly, downwardly, to the right side or to the left side, thereby, the player's moving routes in this playing device can be more diversified than that in a playing device having a straight beam. Therefore, the player can play more happily.

Patent document 1: Japanese Unexamined Patent Application Publication No. 10-314336.

DISCLOSURE OF INVENTION

Problem Invention is to Solve

However, even in the conventional playing device configured as described above, there are problems that the play in the playing device is apt to be monotonous and to make the player bored, and that it is difficult to interest children.

The present invention has been achieved in view of the above-described circumstances, and an object thereof is to provide a playing device in which the player can perform more diversified plays, and also which can interest children.

Means for Resolving the Problem

To achieve the above-described object, the present invention relates to a playing device, comprising:

a beam which is arranged such that its longitudinal direction is directed laterally and which is configured such that a player can move on the outer circumferential surface thereof under a standing state along the longitudinal direction; and a first and a second support means or mechanisms which are arranged at a distance in the longitudinal direction of the beam and which support the both end portions of the beam respectively, the first and second support means or mechanisms for supporting the beam such that one or both end portions of the beam can be displaced freely in the direction intersecting the longitudinal direction.

According to this playing device, like a balance beam, the player such as a child can play by, for example, walking or running on the outer circumferential surface of the beam along the longitudinal direction while keeping his/her balance. The beam is supported by each support means or mechanism such that the one or both end portions thereof can be displaced freely in the direction intersecting the longitudinal direction (for example, the lateral direction, the up-and-down direction, the oblique direction, the rotational direction about the axis, or the pivoting direction about a pivot center axis parallel to the longitudinal direction etc.). Therefore, the player can move on the beam while the beam appropriately moves depending on the player's state of balance or the player's standing position.

Thus, according to the playing device of the present invention, the beam is configured to move. Therefore, compared with the above-described conventional playing device where the beam is fixed, it is possible to increase the difficulty in moving from one end side of the beam to the other end side, to make the player play more happily, to develop the player's sense of balance to a high level, not to make the player bored by preventing the play in the playing device from being monotonous, and to interest children.

The playing device may be configured to further comprise a drive means or mechanism for displacing one or both end portions of the beam in the intersecting direction by driving the beam. The player has to move on the beam while keeping his/her balance, while the beam is driven by the drive means or mechanism and the one or both end portions thereof are displaced. Therefore, when configured in this way, it is possible to increase the difficulty in moving from one end side of the beam to the other end side, to make the player play more happily, to develop the player's sense of balance to a high level, not to make the player bored by preventing the play in the playing device from being monotonous, and to interest children. Further, it is also possible to interest children around the playing device, who see the motion (displacement) of the beam by the drive means or mechanism, in playing with this playing device.

Further, at least one of the first support means or mechanism and the second support means or mechanism may be configured with: a first pivot member to which the end portion of the beam is connected; and a support member by which the first pivot member is supported pivotably about a first pivot center axis parallel to the longitudinal direction of the beam. In this case, when the first pivot member pivots about the first pivot center axis, one or both end portions of the beam are displaced in the direction intersecting the longitudinal direction of the beam. Therefore, the beam swings from side to side when the player cannot balance well in moving. Thus, also when configured in this way, a similar effect to the above can be obtained.

In this case, the playing device may further comprise a pivot means or mechanism for pivoting the first pivot member about the first pivot center axis. Thus, also when the first pivot member is pivoted about the first pivot center axis by the pivot means or mechanism, a similar effect to the above can be obtained.

Further, each support means or mechanism may further comprise a second pivot member to which the end portion of the beam is connected, and the first pivot member of each support means or mechanism may be configured to support the second pivot member such that the second pivot member is pivotable about a second pivot center axis parallel to the first pivot center axis. In this way, the combined motion of the pivoting of the first pivot member by the pivot means or mechanism and the pivoting of the second pivot member depending on the player's state of balance can make it more difficult for the player to move on the beam.

Additionally, the first pivot member and the second pivot member of each support means or mechanism may be configured such that the end portion of the beam is supported rotatabley about its axis. In this way, the beam rotates when the player cannot balance well. Therefore, the rotation of the beam itself can be added to the pivoting motion of the first pivot member or the pivoting motions of the first pivot member and the second pivot member, thereby being able to make it more difficult for the player to move on the beam.

In this case, the playing device may further comprise a rotation drive means or mechanism for rotating the beam about the axis thereof. Thus, also when the beam is rotated about the axis thereof by the rotation drive means or mechanism, a similar effect to the above can be obtained.

Each support means or mechanism may be configured with: a pivot member by which the end portion of the beam is supported pivotably about a first pivot center axis parallel to the longitudinal direction of the beam; and a support member by which the pivot member is supported pivotably about a second pivot center axis parallel to the first pivot center axis. And the playing device may further comprise a pivot means or mechanism for pivoting the pivot member about the second pivot center axis. Also when configured in this way, similarly to the above, the compound motion of the pivoting of the pivot member by the pivoting means or mechanism and the pivoting of the beam depending on the player's state of balance can make it more difficult for the player to move on the beam.

Effects of the Invention

As described above, according to the playing device of the present invention, the playing device is configured such that the beam moves depending on the player's state of balance or the player's standing position, and such that the beam is moved by appropriate means or mechanism. Therefore, compared with the above-described conventional playing device where the beam is fixed, it is possible to increase the difficulty in moving from one end side of the beam to the other end side, to make the player play more happily, to develop the player's sense of balance to a high level, not to make the player bored by preventing the play in the playing device from being monotonous, and to interest children.

LEGEND

Figure 1:
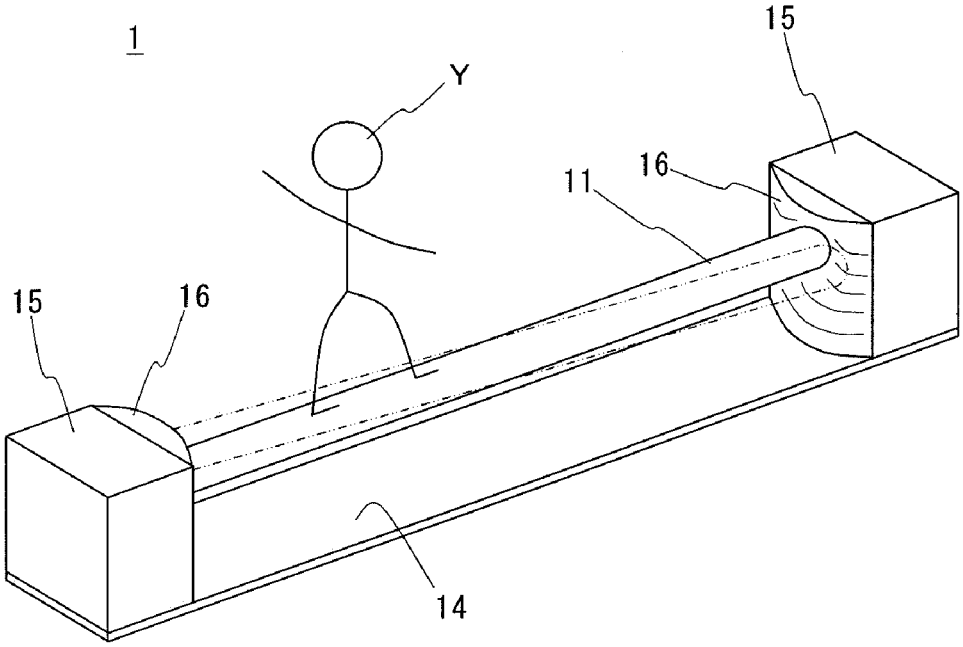
FIG. 1 is a perspective view showing a schematic configuration of a playing device according to one embodiment of the present invention.

1 Playing device
11 Beam
12 First mount
13 Second mount
14 Base
20 First support mechanism
21 Support member
22 First pivot member
23 Second pivot member
25 Second support mechanism
26 Support member
27 First pivot member
28 Second pivot member
30 First pivot mechanism
31 Drive motor
32 Support member
33 Rotating body
34 Connecting member
35 Second pivot mechanism
36 Drive motor
37 Support member
38 Rotating body
39 Connecting member

BEST MODE FOR CARRYING OUT THE INVENTION

Figure 3:
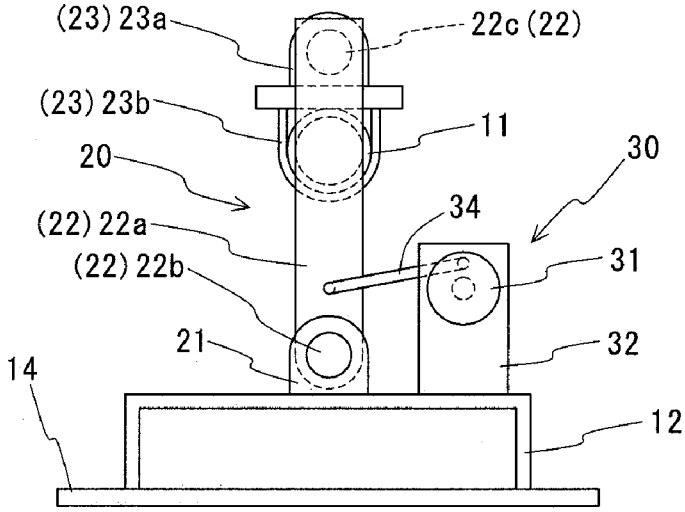
FIG. 3 is a side view as viewed in the arrow A direction in FIG. 2.
Figure 2:
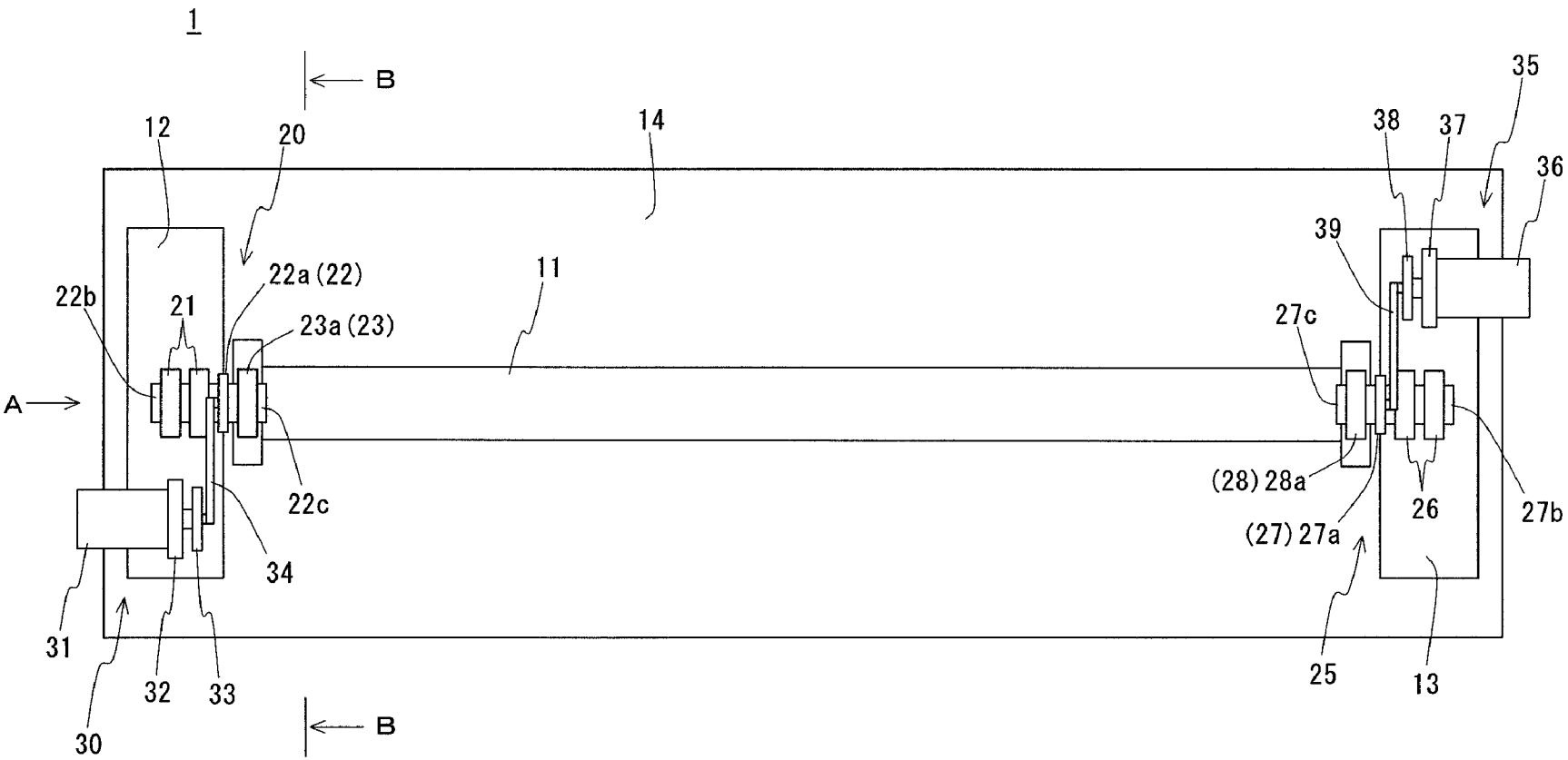
FIG. 2 is a plan view showing a main part of the playing device in FIG. 1.
Figure 4:
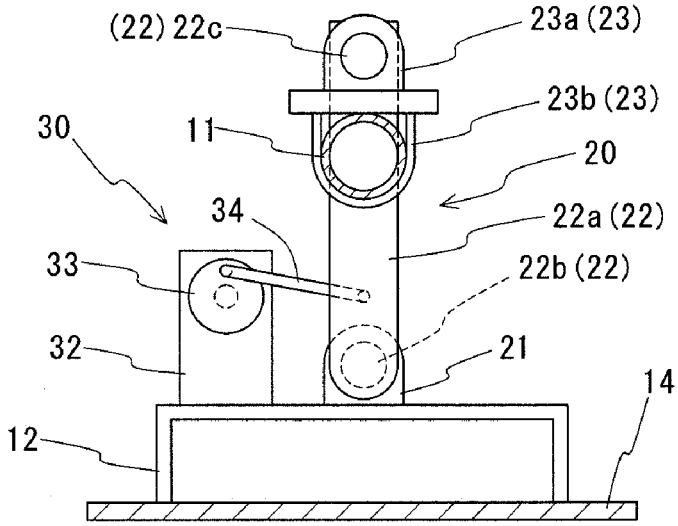
FIG. 4 is a cross-sectional view taken along line B-B in FIG. 2.

Hereinafter, a specific embodiment of the present invention will be described with the reference to the accompanying drawings. FIG. 1 is a perspective view showing a schematic configuration of a playing device according to one embodiment of the present invention. FIG. 2 is a plan view showing a main part of the playing device in FIG. 1, FIG. 3 is a side view as viewed in the arrow A direction in FIG. 2, and FIG. 4 is a cross-sectional view taken along line B-B in FIG. 2.

As shown in FIG. 1 to FIG. 4, a playing device 1 of the embodiment comprises: a beam 11 arranged such that its longitudinal direction is directed laterally; a first support mechanism 20 and a second support mechanism 25 which are arranged at a distance in the longitudinal direction of the beam 11 for supporting the both end portions of the beam 11, respectively; a first pivot mechanism 30 and a second pivot mechanism 35 for pivoting a first pivot members 22 and 27 of each support mechanisms 20 and 25, respectively; a first mount 12 and a second mount 13 which are arranged at a distance in the longitudinal direction of the beam 11, and on which the first support mechanism 20 and the first pivot mechanism 30, and the second support mechanism 25 and the second pivot mechanism 35 are mounted, respectively; and a base 14 on which each mount 12 and 13 is mounted and fixed.

The beam 11 is configured by a tube-shaped member having a circular cross-sectional shape, and is configured such that a player Y such as a child can move on the outer circumferential surface thereof under a standing state along the longitudinal direction (axial direction).

The first support mechanism 20 comprises: a support member 21 fixedly arranged on the upper surface of the first mount 12; the first pivot member 22 supported pivotably about a first pivot center axis parallel to the longitudinal direction of the beam 11 by the support member 21; and a second pivot member 23 which is supported pivotably about a second pivot center axis parallel to the first pivot center axis by the pivot member 22, and to which the one end of the beam 11 is connected.

The first pivot member 22 includes: a flat plate portion 22*a* which is formed in a flat plate and an elongate shape, and which is disposed with its longitudinal direction along the up-and-down direction; a first support shaft 22*b* which is projected from the lower portion of the flat plate portion 22*a*, and which is arranged co-axially with the first pivot center axis; and a second support shaft 22*c* which is projected from the upper portion of the flat plate portion 22*a*, and which is arranged co-axially with the second pivot center axis. The first support shaft 22*b* is supported rotatably by the support member 21. The first support shaft 22*b* is provided on the surface of the flat plate portion 22*a* on the side opposite to the second support mechanism 25 side, and the second support shaft 22*c* is provided on the surface of the flat plate portion 22*a* on the second support mechanism 25 side.

The second pivot member 23 includes: an engagement portion 23*a* which rotatably engages with the second support shaft 22*c* of the first pivot member 22; and a holding portion 23*b* which is formed below the engagement portion 23*a*, and which holds the one end of the beam 11 via an elastic body (not shown) such as rubber.

The second support mechanism 25 comprises: a support member 26 fixedly arranged on the upper surface of the second mount 13; a first pivot member 27 supported pivotably about a first pivot center axis parallel to the longitudinal direction of the beam 11 by the support member 26; and a second pivot member 28 which is supported pivotably about a second pivot center axis parallel to the first pivot center axis by the first pivot member 27, and to which the other end of the beam 11 is connected.

The first pivot member 27 includes: a flat plate portion 27*a* which is formed in a flat plate and an elongate shape, and which is disposed with its longitudinal direction along the up-and-down direction; a first support shaft 27*b* which is projected from the lower portion of the flat plate portion 27*a*, and which is arranged co-axially with the first pivot center axis; and a second support shaft 27*c* which is projected from the upper portion of the flat plate portion 27*a*, and which is disposed co-axially with the second pivot center axis. The first support shaft 27*b* is supported rotatably by the support member 26. The first support shaft 27*b* is provided on the surface of the flat plate portion 27*a* on the side opposite to the first support mechanism 20 side, and the second support shaft 27*c* is provided on the surface of the flat plate portion 27*a* on the first support mechanism 20 side.

The second pivot member 28 includes: an engagement portion 28*a* which rotatably engages with the second support shaft 27*c* of the first pivot member 27; and a holding portion 28*b* which is formed below the engagement portion 28*a* and which holds the other end of the beam 11 via an elastic body (not shown) such as rubber.

The first pivot mechanism 30 includes: a drive motor 31; a support member 32 which is fixedly arranged on the upper surface of the first mount 12 for supporting the drive motor 31; a rotating body 33 fixedly arranged on an output shaft of the drive motor 31; and a connecting member 34 for connecting the outer circumferential side of the rotating body 33 to between the upper end and the lower end of the first pivot member 22.

The second pivot mechanism 35 includes: a drive motor 36; a support member 37 which is fixedly arranged on the upper surface of the second mount 13 for supporting the drive motor 36; a rotating body 38 fixedly arranged on an output shaft of the drive motor 36; and a connecting member 39 for connecting the outer circumferential side of the rotating body 38 to between the upper end and the lower end of the first pivot member 27

Figure 5:
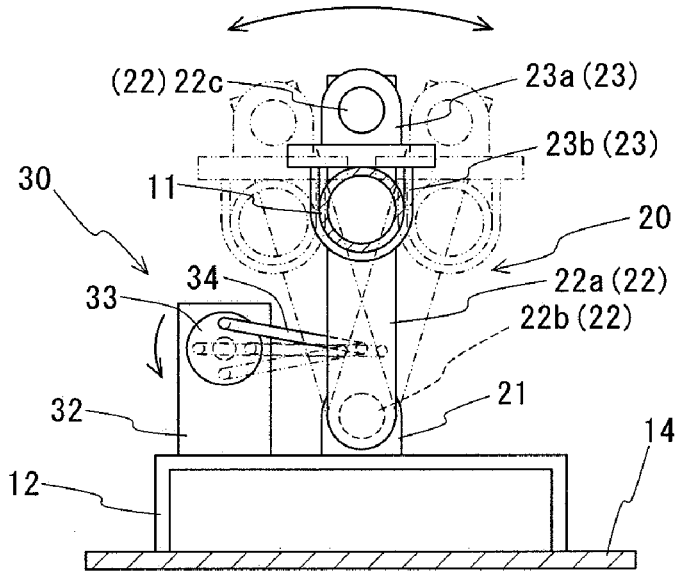
FIG. 5 is an illustrative view for illustrating motions of a support mechanism and a pivot mechanism according to the embodiment.
Figure 6:
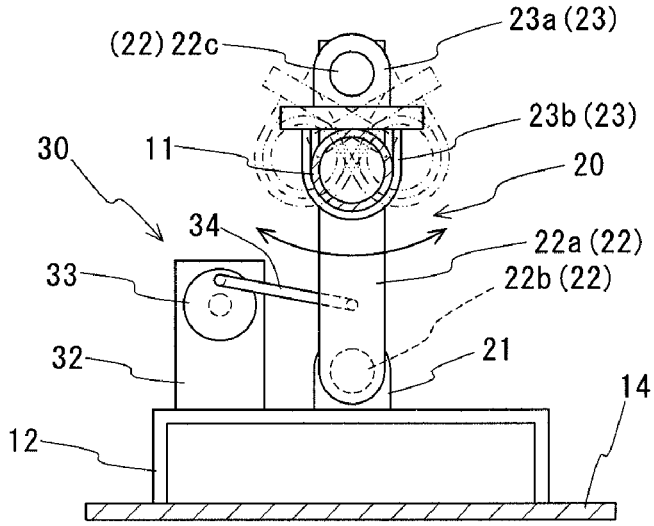
FIG. 6 is an illustrative view for illustrating the motion of the support mechanism according to the embodiment.

According to the first support mechanism 20 and the first support mechanism 30, when the drive motor 31 is driven and the rotating body 33 rotates, the first pivot member 22 pivots about the first support shaft 22*b* by the connection relationship between the connecting member 34 and the first pivot member 22 (see FIG. 5). That is, the first pivot member 22 pivots from side to side of a vertical plane containing the axis line of the first support shaft 22*b*. Further, when an external force is applied, the second pivot member 23 pivots about the second support shaft 22*c* of the first pivot member 22 (see FIG. 6). That is, the second pivot member 23 pivots from side to side of a vertical plane containing the axis line of the second support shaft 22*c*.

According to the second support mechanism 25 and the second pivot mechanism 35, when the drive motor 36 is driven and the rotating body 38 rotates, the first pivot member 27 pivots about the first support shaft 27*b* by the connection relationship between the connecting member 39 and the first pivot member 27 (see FIG. 5). That is, the first pivot member 27 pivots from side to side of a vertical plane containing the axis line of the first support shaft 27*b*. Further, when an external force is applied, the second pivot member 28 pivots about the second support shaft 27*c* of the first pivot member 27 (see FIG. 6). That is, the second pivot member 28 pivots from side to side of a vertical plane containing the axis line of the second support shaft 27*c*.

Figure 7:
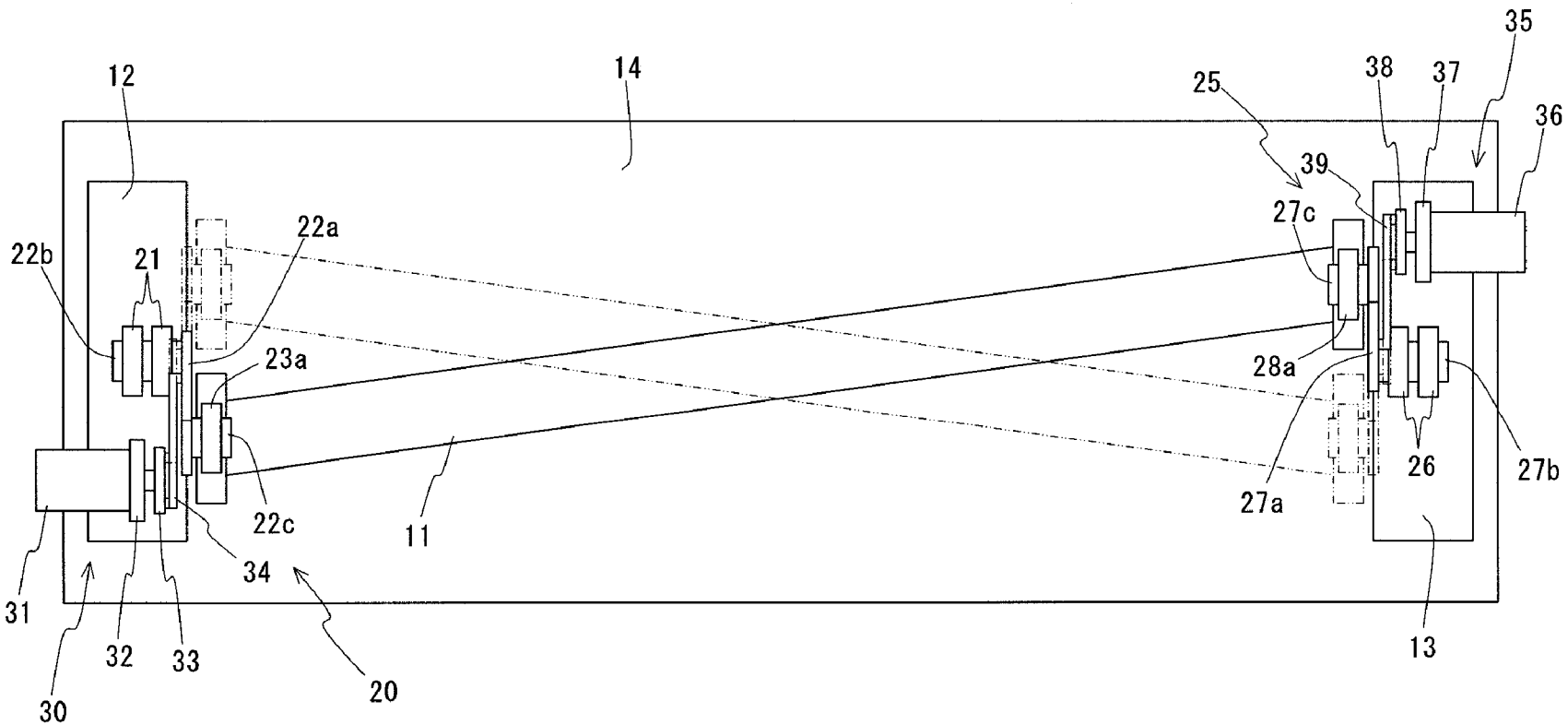
FIG. 7 is an illustrative view for illustrating the motions of the support mechanism and the pivot mechanism according to the embodiment.

As shown in FIG. 7, the first pivot mechanism 30 and the second pivot mechanism 35 pivot members 22 and 27, respectively, such that the pivoting direction of the first pivot member 22 and the pivoting direction of the first pivot member 27 are opposite to each other. At this time, the axis of the beam 11 is tilted to the holding portions 23*b* and 28*b*. However, the tilt can be allowed by, for example, the elastic bodies (not shown) provided between the inner circumferential surface of the holding portion 23*b* and the outer circumferential surface of the beam 11, and between the inner circumferential surface of the holding portion 28*b* and the outer circumferential surface of the beam 11. Further, the distance between the first pivot members 22 and 27 varies. However, the first pivot members 22 and 27 are bent, the first pivot members 22 and 27 are supported so as to be displaced freely in the direction of their respective first pivot center axes by the support members 21 and 26 respectively, and the second pivot members 23 and 28 are supported so as to be displaced freely in the direction of their respective second pivot center axis by the first pivot members 22 and 27 respectively, thereby, the variation is allowed.

Each support mechanism 20 and 25, each pivot mechanism 30 and 35, and each end portion of the beam 11 is provided within a space closed by a box-shaped cover box 15 and a sheet member 16 having flexibility, and this configuration prevents the player Y from being injured. Further, a not shown appropriate shock absorbing member is winded on the outer circumferential portion of the beam 11, and the upper portion of the base 14 is covered with a not shown appropriate shock absorbing member, thereby, preventing the player Y from being injured when the player Y tumbles or falls down.

According to the playing device 1 of the embodiment configured as described above, like a balance beam, the player Y can play by, for example, walking or running on the outer circumferential surface of the beam 11 along the longitudinal direction while keeping his/her balance, while the first pivot members 22 and 27 of each support mechanism 20 and 25 are pivoted about their respective first pivot center axes by the pivot mechanisms 30 and 35 respectively, thereby, the both end portions of the beam 11 are displaced (moved) in the direction intersecting the longitudinal direction thereof.

Further, the second pivot members 23 and 28 of each support mechanism 20 and 25 are supported pivotably about their respective second pivot center axes by the first pivot members 22 and 27, respectively. Therefore, the second pivot members 23 and 28 pivot when the player Y cannot balance well in moving. Thereby, the beam 11 is displaced (moved) in the direction intersecting the longitudinal direction thereof.

In this way, according to the playing device 1 of the embodiment, each first pivot member 22 and 27 is pivoted by each pivot mechanism 30 and 35, and each second pivot member 23 and 28 pivots when the player Y cannot balance well. Thereby, the player Y can play while enjoying the feelings accompanying the combined motion of the pivoting of the first pivot members 22 and 27 by the pivot mechanisms 30 and 35 and the pivoting of the second pivot members 23 and 28 depending on the player Y's state of balance. As a result, compared with the above-described conventional playing device where the beam is fixed, it is possible to increase the difficulty in moving from one end side of the beam 11 to the other end side, to make the player Y play more happily, to develop the player Y's sense of balance to a high level, not to make the player Y bored by preventing the play in the playing device 1 from being monotonous, and to interest children.

Further, it is also possible to interest children around the playing device 1, who see the motion (displacement) of the beam 11 by each pivot mechanism 30 and 35, in playing with this playing device 1.

Thus, one embodiment of the present invention has been described above. However, specific modes in which the present invention can be realized are not limited thereto.

In the above embodiment, the beam 11 is configured by a tube-shaped member having a circular cross-sectional shape. However, the cross-sectional shape of the beam 11 is not particularly limited. For example, the beam 11 may be configured by a tube-shaped member having a rectangular cross-sectional shape, or a solid member having a circular or rectangular cross-sectional shape. Further, each pivot mechanism 30 and 35 is also not limited to the above-described configuration.

Figure 8:
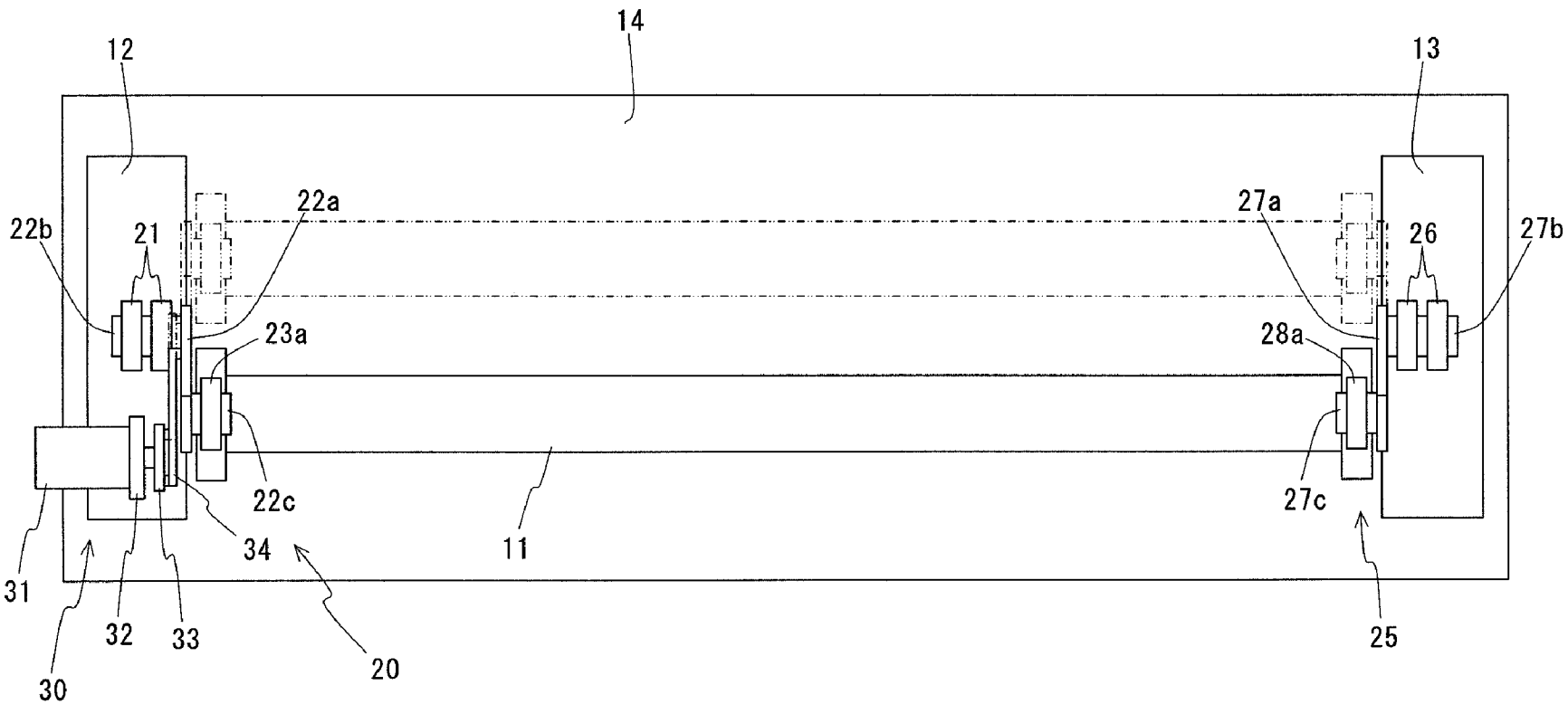
FIG. 8 is an illustrative view for illustrating the motions of the support mechanism and the pivot mechanism according to another embodiment of the present invention.

Further, in the above embodiment, as shown in FIG. 7, each pivot member 22 and 27 is pivoted by each pivot mechanism 30 and 35 such that the pivoting direction of the first pivot member 22 of the first support mechanism 20 and the pivoting direction of the first pivot member 27 of the second support mechanism 25 are opposite to each other. However, as shown in FIG. 8, each pivot member 22 and 27 may be pivoted such that the pivoting direction of the first pivot member 22 and the pivoting direction of the first pivot member 27 are the same. In this case, one of the pivot mechanisms 30 and 35 may be omitted.

Figure 9:
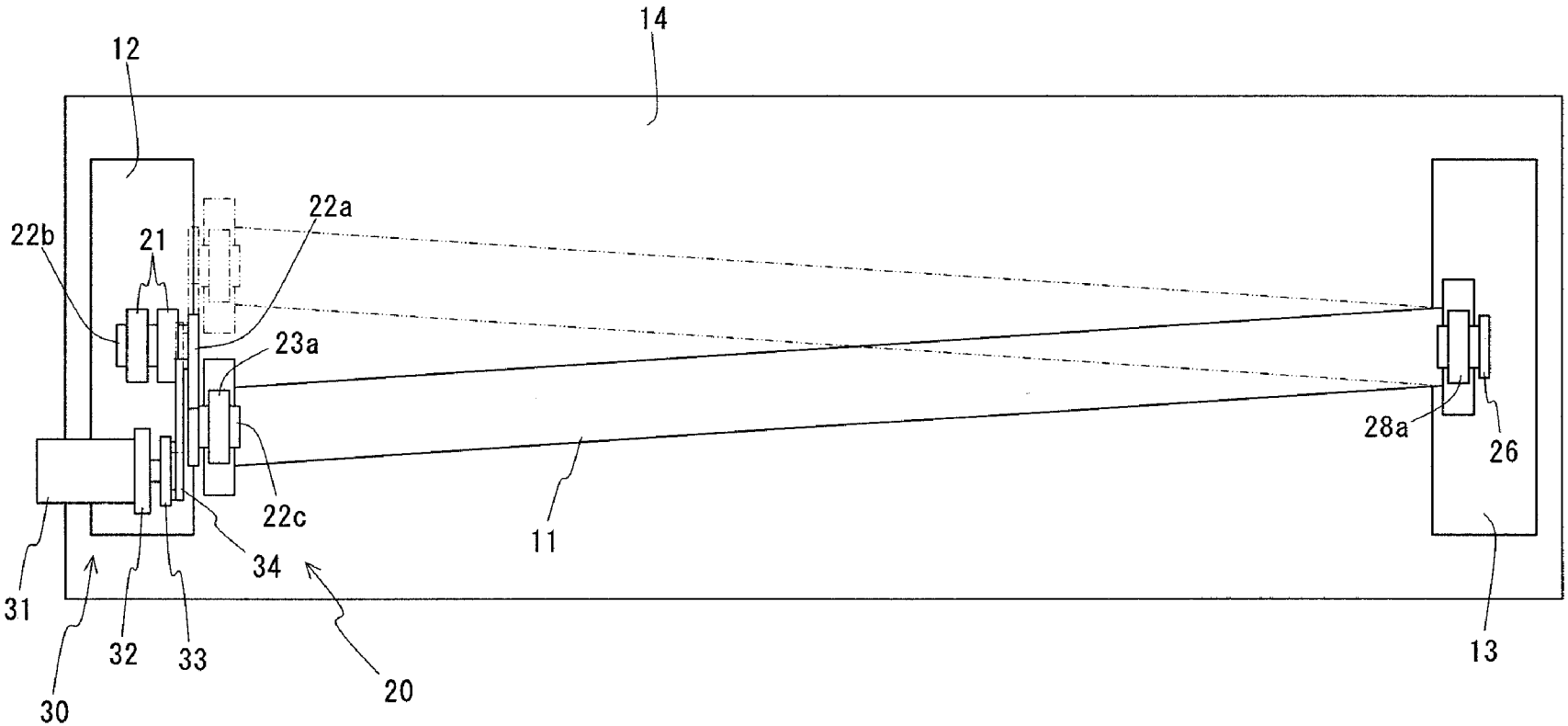
FIG. 9 is a plan view showing the main part of the playing device according to another embodiment of the present invention.

Further, as shown in FIG. 9, it is also possible to omit the first pivot member 27 of the second support mechanism 25 and the second pivot mechanism 35, and to configure the playing device such that the second pivot member 28 is supported pivotably about the second pivot center axis by the support member 26. In this case, when the first pivot member 22 of the first support mechanism 20 is pivoted about the first pivot center axis by the first pivot mechanism 30, the one end of the beam 11 is displaced (moved) in the direction intersecting the longitudinal direction thereof. And, the second pivot members 23 and 28 pivot about the second pivot center axis depending on the player Y's state of balance.

In addition, although not specifically shown in the drawings, it is also possible to omit the first pivot members 22 and 27 of each support mechanism 20 and 25, and each pivot mechanism 30 and 35, and to configure the playing device such that the second pivot members 23 and 28 are supported pivotably about their respective second pivot center axes by the support members 21 and 26, respectively. In this case, the beam 11 is displaced (moved) in the direction intersecting the longitudinal direction thereof only by the pivoting of the second pivot members 23 and 28 depending on the player Y's state of balance.

Figure 10:
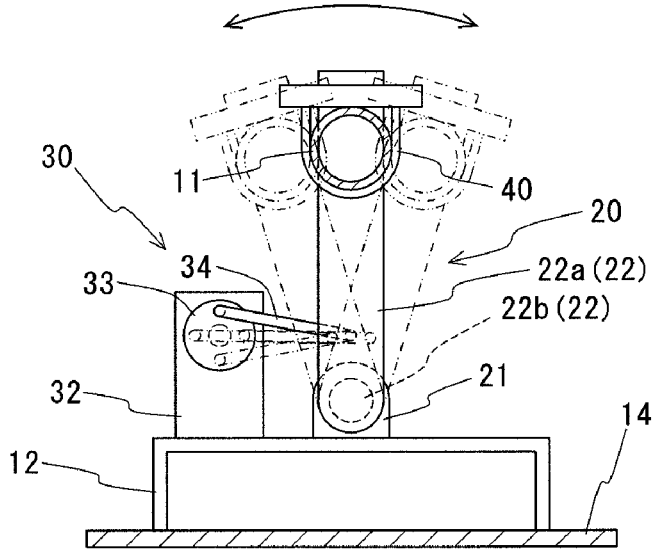
FIG. 10 is a cross-sectional view showing a part of the playing device according to another embodiment of the present invention.

Further, as shown in FIG. 10, the second pivot members 23 and 28 of each support mechanism 20 and 25 may be omitted, and then a holding member 40 for appropriately holding the end portion of the beam 11 may be fixedly arranged on each first pivot member 22 and 27. In this case, only when the first pivot members 22 and 27 are pivoted by each pivot mechanism 30 and 35, the beam 11 is displaced (moved) in the direction intersecting the longitudinal direction thereof. Further, in this case, it is possible to further omit the first pivot member 27 on the second support mechanism 25 side, and, as shown in FIG. 9, to configure the playing device such that only the first pivot member 22 of the first support mechanism 20 is pivoted about the first pivot center axis by the first pivot mechanism 30, thereby, the one end of the beam 11 is displaced (moved) in the direction intersecting the longitudinal direction thereof.

Figure 11:
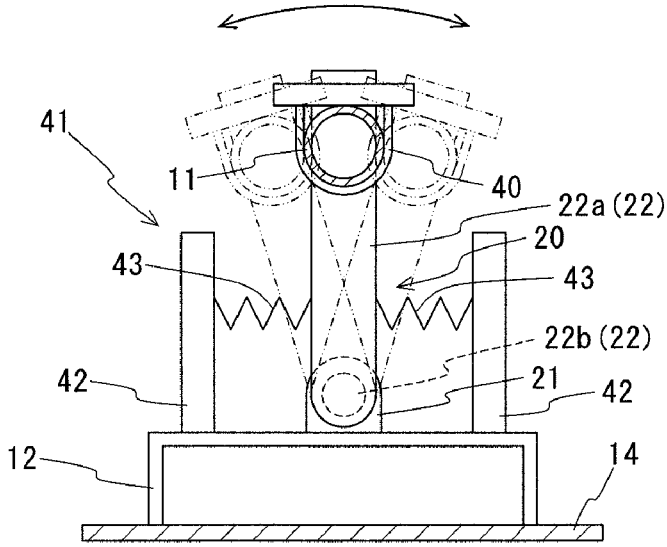
FIG. 11 is a cross-sectional view showing a part of the playing device according to another embodiment of the present invention.

Further, each pivot mechanism 30 and 35 may be omitted, and as shown in FIG. 11, holding mechanisms 41 may be provided for holding the first pivot members 22 and 27 of each support mechanism 20 and 25 at their respective exact middle positions in the pivoting direction thereof and replacing the first pivot members 22 and 27 to their respective middle positions when they move from their respective middle positions to either side. Or, as shown in FIG. 12, regulating mechanisms 44 may be provided for regulating the pivoting of the first pivot members 22 and 27 in contact with the first pivot members 22 and 27 of each support mechanism 20 and 25.

As shown in FIG. 11, each of the holding mechanisms 41 is configured with: two support members 42 which are fixedly arranged on the upper surface of each mount 12 and 13, and which are disposed on both sides of each first pivot member 22 and 27 at a certain distance from them; and two spring bodies 43 which are disposed such that their respective axes are directed in the lateral direction intersecting the longitudinal direction of the beam 11, and which are provided between each support member 42 and the first pivot member 22, and between each support member 42 and the first pivot member 27.

According to this holding mechanism 41, when the first pivot members 22 and 27 pivot from their respective exact middle positions in the pivot direction thereof (such positions of the first pivot members 22 and 27 as the axis of the beam 11 is contained in the vertical plane containing the axis line of the first support shaft 22*b*) depending on the player Y's state of balance, they are replaced to their respective middle positions by biasing forces of the spring bodies 43.

Figure 12:
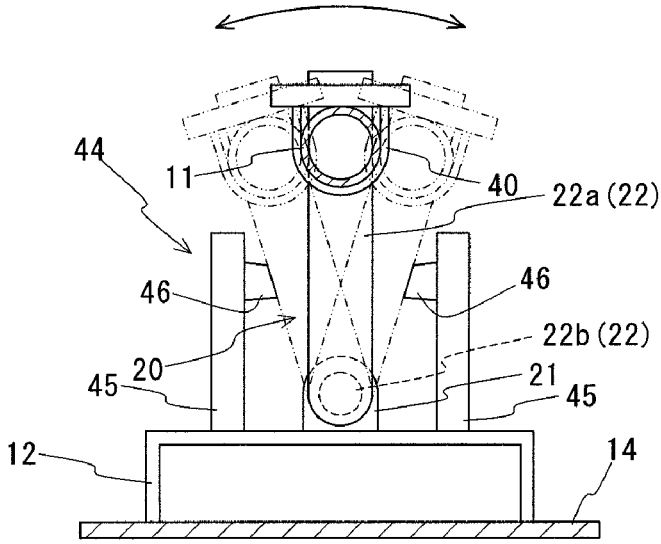
FIG. 12 is a cross-sectional view showing a part of the playing device according to another embodiment of the present invention.

Further, as shown in FIG. 12, each of the regulating mechanisms 44 is configured with two support members 45 which are fixedly arranged on the upper surface of each mount 12 and 13, and which are disposed on both sides of each first pivot member 22 and 27 at a distance from them; and two contact members 46 which are projected from the side surface of each support member 45 on the first pivot member 22 side or on the first pivot member 27 side.

According to this regulating mechanism 44, the first pivot members 22 and 27 are pivoted depending on the player Y's state of balance. When the amount of pivoting (an angle of tilt) exceeds a certain value, the first pivot members 22 and 27 come into contact with the contact members 46, thereby, the pivoting is regulated.

In FIG. 11 and FIG. 12, the holding mechanism 41 and the regulating mechanism 44 are each provided for each support mechanism 20 and 25. However, they are not limited thereto. They may be provided for only one of the support mechanisms 20 and 25.

In the above embodiments, the beam 11 is configured so as to be displaced in the direction intersecting the longitudinal direction thereof by pivoting the first pivot members 22 and 27, or the second pivot members 23 and 28. However, they are not limited thereto. For example, the one end (the other end) or both end portions of the beam 11 may be disposed in a long hole which is formed with the longitudinal direction thereof along the direction intersecting the longitudinal direction of the beam 11 so as to be able to slide, or be adapted to be slid in the direction intersecting the longitudinal direction thereof by appropriate drive means such as a drive cylinder.

Figure 13:
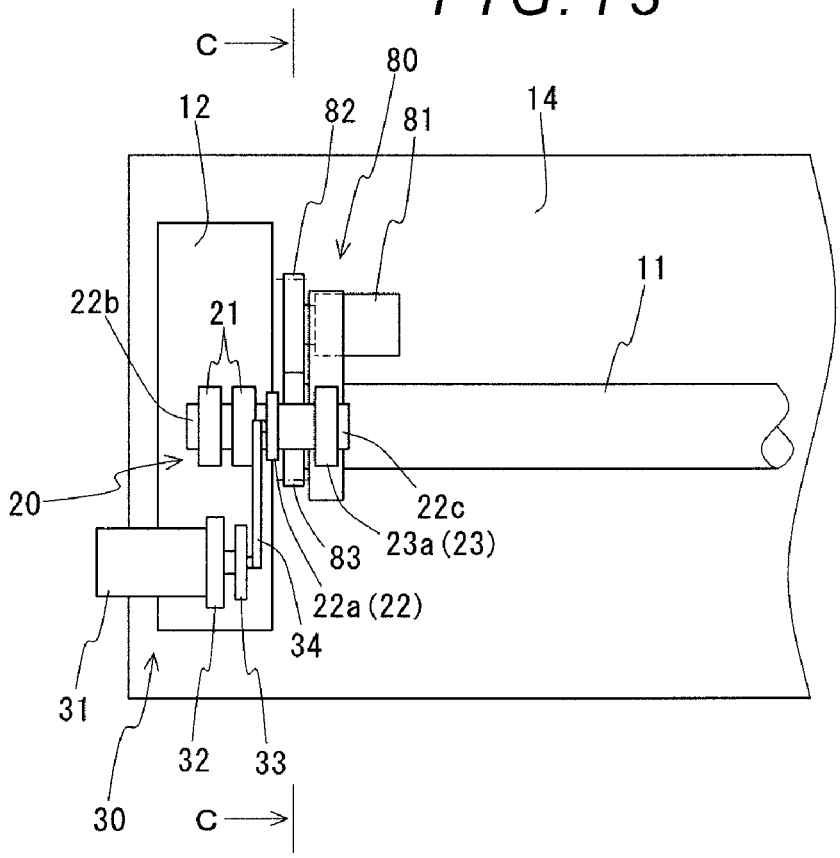
FIG. 13 is a plan view showing the main part of the playing device according to another embodiment of the present invention.
Figure 14:
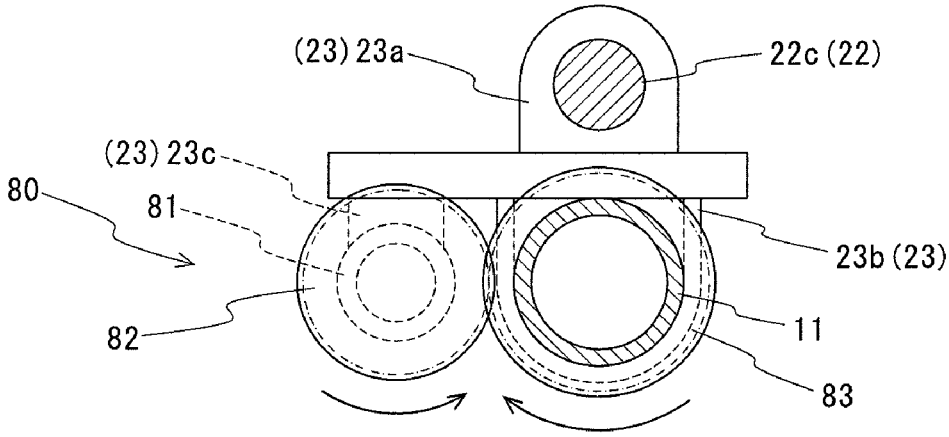
FIG. 14 is a cross-sectional view taken along line C-C in FIG. 13.

Further, in the above embodiments, the beam 11 is non-rotating. However, as shown in FIG. 13 and FIG. 14, a rotation drive mechanism 80 may be provided, and the beam 11 may be rotated about the axis thereof by the rotation drive mechanism 80. In this case, both end portions of the beam 11 are supported rotatably by the holding portions 23*b* and 28*b* via bearings (not shown) or rollers (not shown), and the second pivot member 23 further comprises a mounting portion 23*c* to which a drive motor 81 configuring the rotation drive motor 80 is connected. And, the rotation drive mechanism 80 includes the drive motor 81, a first gear 82 fixedly arranged on an output shaft of the drive motor 81; and a second gear 83 which is fitted onto the one end of the beam 11 and is meshed with the first gear 82.

According to this rotation drive mechanism 80, when the drive motor 81 is driven, its drive force is transmitted to the beam 11 via the first gear 82 and the second gear 83. Thereby, the beam 11 rotates about the axis thereof (the beam 11 is displaced in the direction intersecting the longitudinal direction thereof). In this way, by rotating the beam 11 about the axis thereof, the rotation of the beam 11 itself can be added to the above motion of the beam 11, thereby being able to make it more difficult for the player Y to move on the beam 11.

The beam 11 may be configured to rotate only in one direction, may also be configured to rotate in the forward and reverse directions. Further, in the playing devices shown in FIG. 2, FIG. 3, FIG. 4 and FIG. 9, the beam 11 is adapted to rotate about the axis thereof. However, also in the playing devices shown in FIG. 10, FIG. 11 and FIG. 12, or the playing device in other embodiments than the above-described embodiments, which is not shown in the drawings, the beam 11 can be configured to rotate about the axis thereof. Additionally, although not specifically shown in the drawings, the beam 11 may be adapted only to rotate by omitting the first pivot members 22 and 27 and the second pivot members 23 and 28, and supporting both end portions of the beam 11 by means of appropriate support member such that the beam 11 is rotatable about the axis thereof.

In the above embodiments, the beam 11 is moved by pivoting the first pivot members 22 and 27, or the second pivot members 23 and 28. However, it is not limited thereto. The beam 11 may be moved (displaced in the direction intersecting the longitudinal direction of the beam 11) by pivoting the beam 11 itself In this case, both end portions of beam 11 are supported pivotably about a pivot center axis parallel to the longitudinal direction thereof by a first support member 50 and a second member 51 which have a rectangular cross sectional shape and which are fixedly arranged on the upper surface of each mount 12 and 13, respectively.

Figure 15:
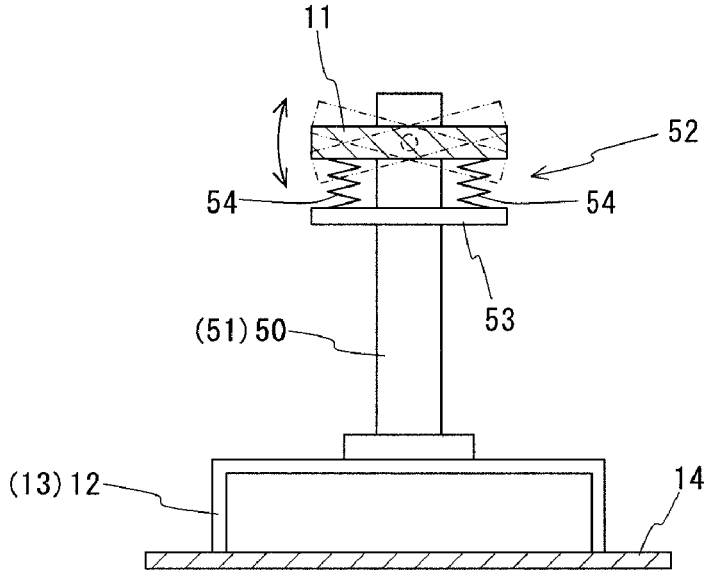
FIG. 15 is a cross-sectional view showing a part of the playing device according to another embodiment of the present invention.
Figure 16:
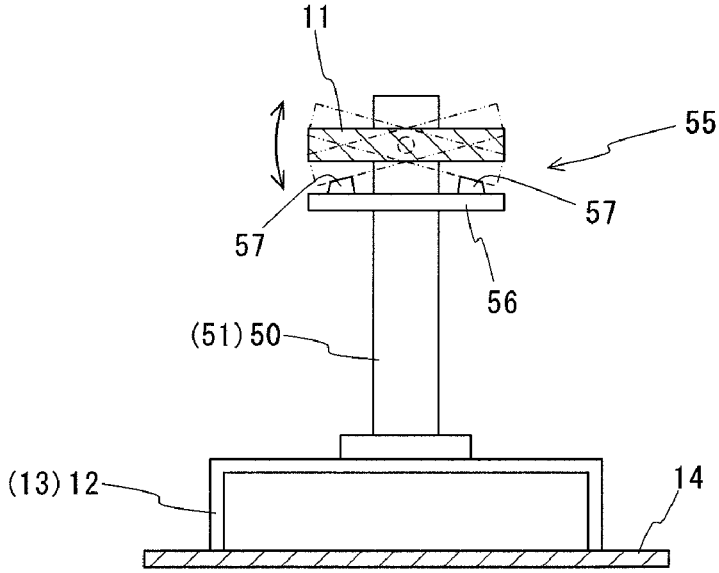
FIG. 16 is a cross-sectional view showing a part of the playing device according to another embodiment of the present invention.

Also in the playing device comprising such a beam 11, although not specifically shown in the drawings, the beam 11 may be pivoted about the pivot center axis by an appropriate pivot mechanism. Further, as shown in FIG. 15, by holding mechanisms 52, the beam 11 may be held at the exact middle position in the pivot direction and be replaced to this middle position when moving to either side, or, as shown in FIG. 16, the pivoting of the beam 11 may be regulated by regulating mechanisms 55.

Each of the holding mechanisms 52 is configured with: a support member 53 supported by each support member 50 and 51 below the beam 11; and two spring bodies 54 which are disposed on both sides of the pivot center axis such that their respective axes are directed in the up-and-down direction, and which are provided between the upper surface of each support member 53 and the lower surface of the beam 11. In this holding mechanism 52, when the beam 11 pivots from the exact middle position in the pivoting direction (such position as the upper surface of the beam 11 is horizontal) depending on the player Y's state of balance and the beam 11 pivots, the beam 11 is replaced to the middle position by biasing forces of the spring bodies 54.

Each of the regulating mechanisms 55 is configured with: a support member 56 supported by each support member 50 and 51 below the beam 11; and two contacting members 57 which are disposed on both sides of the pivot center axis and are vertically arranged on the upper surface of the support member 56. In this regulating mechanism 55, the beam 11 pivots depending on the player Y's state of balance. When the amount of pivoting (an angle of tilt) exceeds a certain value, the beam 11 comes into contact with the contacting members 57 and the pivoting of the beam 11 is regulated.

Like the first pivot members 22 and 27, each support member 50 and 51 may be configured to be pivotable about a pivot center axis parallel to the longitudinal direction of the beam 11, and to be pivoted by appropriate means or mechanism such as the pivot mechanisms 30 and 35. Further, in FIG. 15 and FIG. 16, the holding mechanism 52 and the regulating mechanism 55 are provided for each support member 50 and 51. However, they are not limited thereto. They may be provided for only one of the support members 50 and 51.

Figure 17:
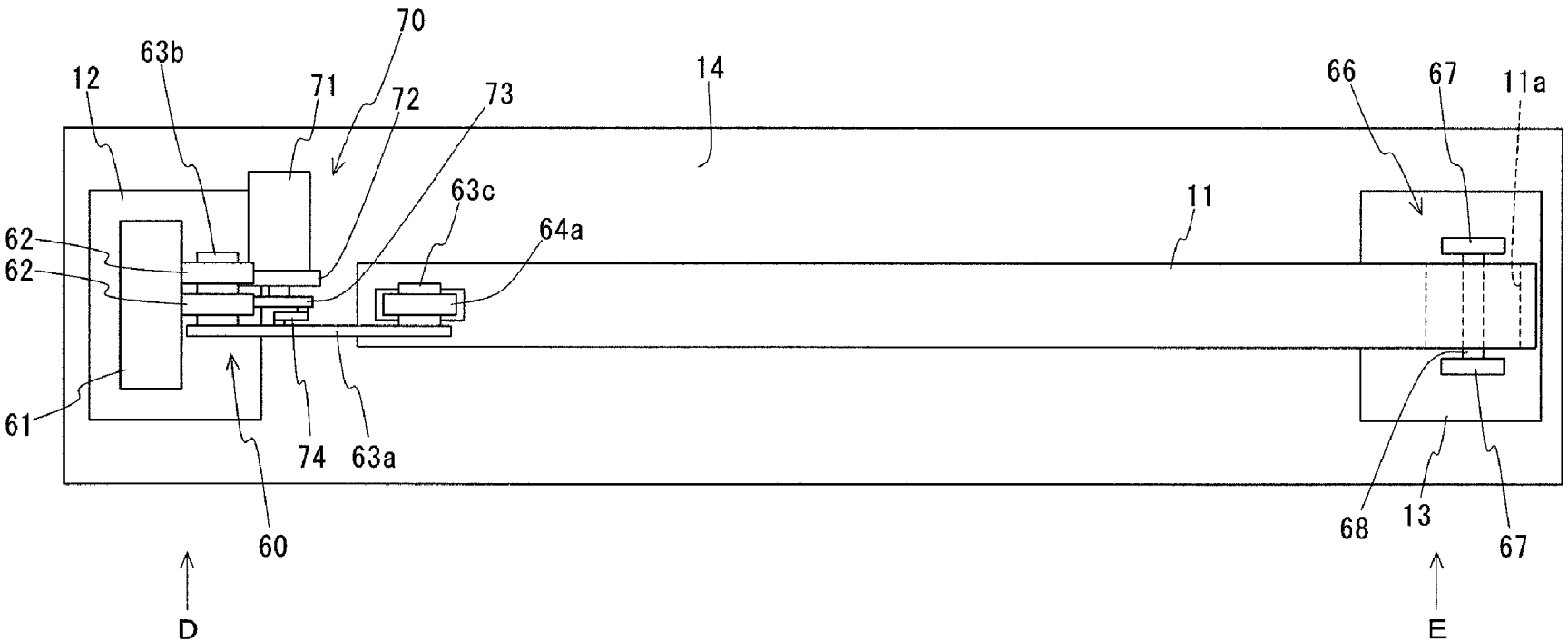
FIG. 17 is a plan view showing the main part of the playing device according to another embodiment of the present invention.
Figure 18:
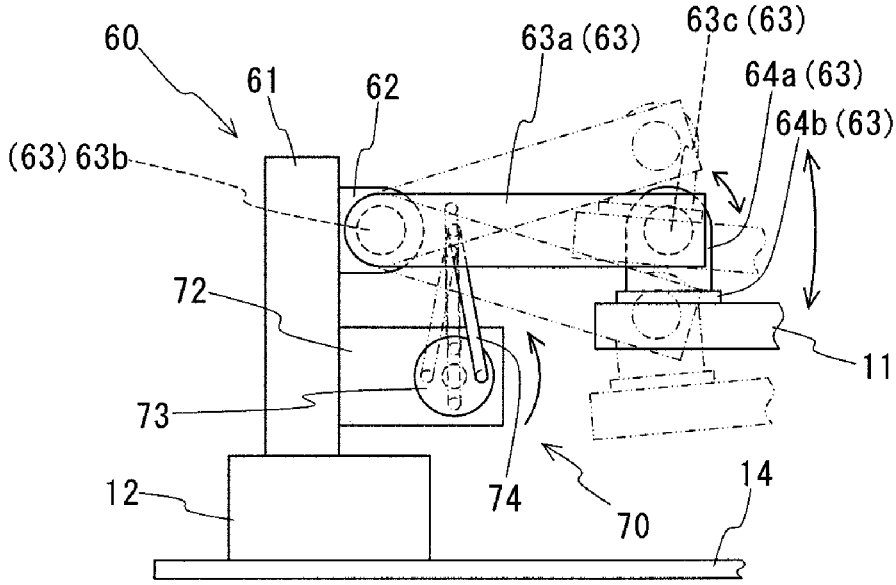
FIG. 18 is a side view as viewed in the arrow D direction in FIG. 17.
Figure 19:
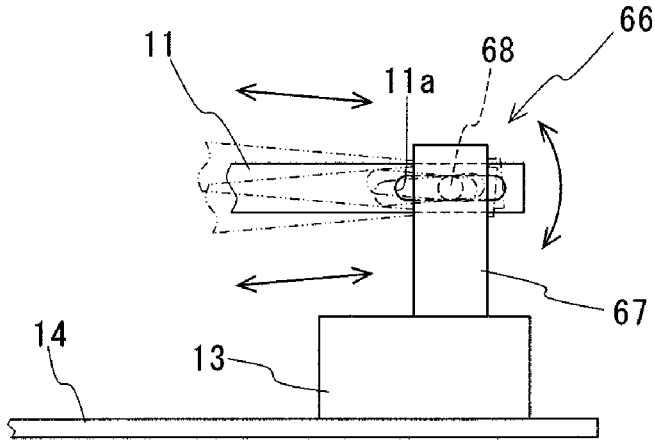
FIG. 19 is a side view as viewed in the arrow E direction in FIG. 17.

In addition, as shown in FIG. 17 to FIG. 19, the playing device can be configured such that the one end of the beam 11 is displaced in the up-and-down direction, for example. In this way, for example, the beam 11 is formed to have a rectangular cross-sectional shape, and a long hole 11*a* is formed at the other end side of the beam 11 with its longitudinal direction along the longitudinal direction of the beam 11 so as to open to both side surfaces of the beam 11.

A first support mechanism 60 for supporting the one end of the beam 11 comprises: a support block 61 vertically arranged on the upper surface of the first mount 12; a support member 62 fixedly arranged on the side surface of the support block 61 on a second support mechanism 66 side; a first pivot member 63 supported pivotably about a horizontal first pivot center axis perpendicular to the longitudinal direction of the beam 11 by the support member 62; and a second pivot member 64 which is supported pivotably about a second pivot center axis parallel to the first pivot center axis by the first pivot member 63, and to which the one end of the beam 11 is connected.

The first pivot member 63 includes: a flat prate portion 63*a* which is formed in a flat plate and an elongate shape, and which is disposed such that its longitudinal direction is directed in the lateral direction; a first support shaft 63*b* which is fixedly arranged on the left end of the flat plate portion 63*a* and which is arranged co-axially with the first pivot center axis; and a second support shaft 63*c* which is fixedly arranged on the right end of the flat plate portion 63*a*, and which is arranged co-axially with the second pivot center axis. The first support shaft 63*b* is supported rotatably by the support member 62.

The second pivot member 64 includes: an engagement portion 64*a* which rotatably engages with the second support shaft 63*c* of the first pivot member 63; and a holding portion 64*b* which is formed below the engagement portion 64*a* for holding and fixing the one end of the beam 11.

On the other hand, the second support mechanism 66 for supporting the other end of the beam 11 includes two support members 67 disposed on the upper surface of the second mount 13 at a certain distance in the first pivot center axis direction; and a support shaft 68 which is put between the support members 67, and which is inserted into the long hole 11*a* of the beam 11.

Further, a drive mechanism 70 for displacing the one end of the beam 11 in the up-and-down direction includes: a drive motor 71; a support member 72 fixedly arranged on the side surface of the support block 61 on the second support mechanism 66 side for supporting the drive motor 71; and a rotating body 73 fixedly arranged on an output shaft of the drive motor 71; and a connecting member 74 for connecting the outer circumferential side of the rotating body 73 to between the right end and the left end of the first pivot member 63.

According to each support mechanism 60 and 66 and the drive mechanism 70 configured in this way, when the drive motor 71 is driven and the rotating body 73 rotates, the first pivot member 63 pivots about the first support shaft 63*b* by the connection relationship between the connecting member 74 and the first pivot member 63. Thereby, the one end of the beam 11 moves in the up-and-down direction, and the beam 11 pivots about the support shaft 68. At this time, the tilt generated by the pivoting of the beam 11 is allowed by the pivoting of the second pivot member 64 about the second support shaft 63*c*. Further, the movement of the beam 11 in the longitudinal direction thereof is allowed by the long hole 11*a*.

In the embodiment as shown in FIG. 17 to FIG. 19, only the one end of the beam 11 is displaced in the up-and-down direction. However, both ends of the beam 11 may be displaced in the up-and-down direction. Further, the drive mechanism 70 is not limited to the above, and may be configured with a drive cylinder and other components, for example.

In the playing device according to the above described variations, compared with the above conventional one in which the beam is fixed, it is possible to make the playing device more attractive by the motion of the beam 11, and a similar effect to the above can be obtained.

Industrial Applicability

As described in detail above, the present invention is preferably applicable as a playing device with which a player can perform more diversified play, and which can interest children.

What is claimed is:

1. A playing device, comprising:

a beam which is disposed such that its longitudinal direction is directed laterally and which is configured such that a player can move on the outer circumferential surface of the beam thereof along the longitudinal direction;

first and second vertical supports attached at the respective ends of the beam and having lower ends attached to a base, the vertical supports are disposed for supporting each end portion of the beam, respectively; and a mechanism connected to at least one of the first and second vertical supports that allows or prevents at least one end portion of the beam to move laterally in opposite directions and the mechanism includes at least one pivot member disposed in at least one of an upper portion and a lower portion of the at least one of the first and second vertical supports.

2. The playing device according to claim 1, further comprising a drive motor displacing at least one of the end portions of the beam.

3. The playing device according to claim 1, wherein at least one of the first vertical support and the second vertical support includes the at least one pivot member to which one of the end portions of the beam is operationally connected; and a support member for supporting the at least one pivot member pivotably about a first pivot center axis parallel to the longitudinal direction of the beam.

4. The playing device according to claim 3, wherein the at least one pivot member is a first pivot member and the playing device further comprising a pivot mechanism for pivoting the first pivot member about the first pivot center axis.

5. The playing device according to claim 3, wherein the at least one pivot member and the support member are configured to support one end portion of the beam rotatably.

6. The playing device according to claim 5, further comprising a rotation drive mechanism rotating the beam about a longitudinal axis thereof.

7. The playing device according to claim 4, further comprising a second pivot member to which another of the end portions of the beam is connected, and the second pivot member is supported pivotably about a second pivot center axis parallel to the first pivot center axis.

8. The playing device according to claim 7, wherein the second pivot member is configured to support the end portion of the beam rotatably about a longitudinal axis of the beam.

9. The playing device according to claim 8, further comprising a rotation drive mechanism for rotating the beam about the longitudinal axis thereof.

10. The playing device according to claim 1, wherein each support comprises: a pivot member for supporting the end portion of the beam pivotably about a first pivot center axis parallel to the longitudinal direction of the beam; and a support member for supporting the pivot member pivotably about a second pivot center axis parallel to the second pivot center axis, the playing device further comprising a pivot mechanism for pivoting the pivot member about the second pivot center axis.

11. The playing device according to claim 4, wherein the first pivot member is configured to support the end portion of the beam rotatably about a longitudinal axis of the beam.

12. The playing device according to claim 11, further comprising a drive motor for rotating the beam about the longitudinal axis thereof.

13. The playing device according to claim 1, wherein both of said first and second vertical supports each include the at least one pivot member adjacent the base.

14. The playing device according to claim 1, wherein at least one of said first and second vertical supports includes a second pivot member in an upper portion of each of the vertical supports.

15. The playing device according to claim 1, wherein both of said first and second vertical supports include a second pivot member in an upper portion of each of the vertical supports.

* * * * *